US011825910B2

(12) United States Patent
Cappell et al.

(10) Patent No.: US 11,825,910 B2
(45) Date of Patent: Nov. 28, 2023

(54) DETACHABLE LACE TIGHTENING SYSTEM

(71) Applicants: Dillon Cappell, Toronto (CA); Alessandro Cunsolo, Toronto (CA)

(72) Inventors: Dillon Cappell, Toronto (CA); Alessandro Cunsolo, Toronto (CA)

( * ) Notice: Subject to any disclaimer, the term of this patent is extended or adjusted under 35 U.S.C. 154(b) by 0 days.

(21) Appl. No.: 17/705,140

(22) Filed: Mar. 25, 2022

(65) Prior Publication Data

US 2022/0304423 A1 Sep. 29, 2022

(30) Foreign Application Priority Data

Mar. 29, 2021 (CA) ..... CA 3113509

(51) Int. Cl.
*A43C 1/06* (2006.01)

(52) U.S. Cl.
CPC ..... *A43C 1/06* (2013.01)

(58) Field of Classification Search
CPC ..... A43C 1/06; A43C 11/20; A43C 11/165
See application file for complete search history.

(56) References Cited

U.S. PATENT DOCUMENTS 4,748,726 A * 6/1988 Schoch ..... A43C 11/165 24/68 B
6,267,390 B1 * 7/2001 Maravetz ..... A43C 1/06 36/119.1
7,591,050 B2 9/2009 Hammerslag
10,314,365 B2 6/2019 Dervin
10,383,403 B2 * 8/2019 Modena ..... A43C 1/003
10,543,630 B2 * 1/2020 Hipwood ..... B29C 45/14311
2003/0204938 A1 * 11/2003 Hammerslag ..... A43C 11/004 24/68 SK
2008/0060167 A1 * 3/2008 Hammerslag ..... A43C 11/165 24/714.6
2010/0299959 A1 * 12/2010 Hammerslag ..... A43C 11/16 36/50.5

(Continued)

FOREIGN PATENT DOCUMENTS

FR 2473280 A1 12/1983

OTHER PUBLICATIONS

K2 Alexis Boa Women's Ice Skates | Sport Chek; 4 Pages.
Reebok BOA Skates, Misses/Girls—Canadian Tire—Toronto (torontoprices.ca). 1 Page.

*Primary Examiner* — Robert Sandy
*Assistant Examiner* — Rowland Do
(74) *Attorney, Agent, or Firm* — Smart & Biggar LP

(57) ABSTRACT

A detachable lace tightening system for existing footwear is disclosed. The footwear includes a boot having first and second opposing sides with a plurality of eyelets and a tongue arranged between the opposing sides. The system includes a rotatable spool detachably secured to the tongue and a tightening control knob. A cable is insertable into the eyelets such that the first and second ends of the cable extend outwardly from the eyelets at the upper end of the footwear, the ends being removably secured to the spool such that rotation of the control knob in a first direction winds the cable around the spool placing the cable in tension and pulling the opposing sides together. A releasable lock prevents rotation of the spool in a second direction. Release of the lock permits the spool to rotate in the second direction releasing the tension thereby allowing removal of the footwear.

14 Claims, 7 Drawing Sheets

(56) References Cited

U.S. PATENT DOCUMENTS

| | | | | |
|---|---|---|---|---|
| 2014/0223704 | A1* | 8/2014 | Chang | A43C 11/165<br>24/68 SK |
| 2014/0290016 | A1* | 10/2014 | Lovett | A43C 1/04<br>242/378.1 |
| 2014/0359981 | A1* | 12/2014 | Cotterman | A43C 11/20<br>24/712.9 |
| 2015/0359296 | A1 | 12/2015 | Gulla | |
| 2017/0065029 | A1* | 3/2017 | Bordin | A43C 1/00 |
| 2018/0199659 | A1* | 7/2018 | Lintaman | A43C 11/146 |
| 2020/0282542 | A1* | 9/2020 | Petursson | B25G 1/002 |
| 2020/0345107 | A1* | 11/2020 | Burt | A43C 17/02 |
| 2020/0346888 | A1* | 11/2020 | Kruse | A43B 23/0205 |

* cited by examiner

DETACHABLE LACE TIGHTENING SYSTEM

FIELD

The present invention relates to footwear. More particularly, the present invention relates to a detachable lacing system that allows for attaching and removing of an alternate lacing system onto laceable footwear, such as a hockey skate without altering the footwear. The lacing system allows for easily adoption and removal of a dial based, low-friction wire or nylon cable, threadable through the guide members of the footwear, with the ends of the wire or nylon cable insertable and tightened by a dial, detachable to the tongue of the footwear, facilitating equilibrated tightening pressure across a wearer's foot for sports boots and shoes.

BACKGROUND

There currently exists a number of mechanisms and methods for tightening a shoe or boot such as a skate. The most common method of tying skates comprises threading a traditional cloth lace in a zig-zag pattern through eyelets that run in two parallel rows attached to opposite sides of the tongue of shoe. As discussed in prior lacing solution patents, such as U.S. Pat. No. 6,289,558: The shoe is tightened by first tensioning opposite ends of the threaded lace to pull the two rows of eyelets towards the midline of the foot and then tying the ends together to maintain the tension. A number of drawbacks are associated with this type of lacing system. First, laces do not adequately distribute the tightening force along the length of the threaded zone, due to friction between the lace and the eyelets, so that portions of the lace are slack and other portions are in tension. Consequently, the higher tensioned portions of the shoe are tighter around certain sections of the foot, particularly the ankle portions which are closer to the lace ends. This is uncomfortable and can adversely affect performance in some sports.

Another drawback associated with conventional laces is that it is often difficult to untighten or redistribute tension on the lace, as the wearer must loosen the lace from each of the many eyelets through which the laces are threaded. The lace is not easily released by simply untightening the knot. The friction between the lace and the eyelets often maintains the toe portions and sometimes much of the foot in tension even when the knot is released. Consequently, the user must often loosen the lace individually from each of the eyelets. This is especially tedious if the number of eyelets is high, such as in ice-skates or other laceable footwear.

Attempts to address the deficiencies are lacing systems that are formed as part of the footwear member and are not adaptable as add ons to existing skates or boots which would otherwise utilize the traditional lacing systems.

For example, known lacing improvement systems are integrally formed as part of the boot, comprising a footwear member (such as a skate), including a first and second opposing sides configured to fit around a foot. A plurality of opposing cable guide members (eyelets) are positioned on the opposing sides. Such systems are not designed to be adaptable to an existing boot or skate, without altering the guide members and involve an integrally formed tightening spool onto the boot.

There is therefore a need for an aforementioned lace tightening system for footwear that addresses the deficiencies of traditional lacing systems being easily adaptable to existing footwear, such as skates without the need to alter the existing footwear or skate in any way.

SUMMARY OF INVENTION

In accordance with an aspect of the invention there is provided, a detachable lace tightening system for footwear, said footwear including a boot having first and second opposing sides configured to fit around a foot. A plurality of opposing cable guide members (eyelets) are positioned on the opposing sides from a lower toe end to an upper ankle end. A footwear tongue extends from boot between the opposing sides. The tightening system comprises: a rotatable spool detachably secured to the tongue of the footwear, a cable insertable into the guide members (also referred to interchangeably as eyelets) having a first end and a second end; the first and second ends extend outwardly from the guide members at the upper end of the opposing sides and the first and second ends are removably secured within the rotatable spool. A tightening control knob is connected to said spool for winding the cable around the spool to place tension on the cable in a first direction, thereby pulling opposing sides of the footwear towards each other over the tongue. A releasable lock is provided on the spool for preventing rotation of the spool in the second direction whereby releasing the lock permits the spool to rotate in the second direction to release the tension in the cable and allow removal of the boot.

In accordance with an aspect of the invention, the rotatable spool is detachably secured to the tongue of the boot by means of 2 sided tape.

In accordance with an aspect of the invention, the rotatable spool is detachably secured to a dial housing unit, which is itself detachably secured to the tongue of the boot by means of two sided tape. In accordance with an aspect of the invention, the dial housing unit includes a cover which may be slid or put into place to protect the spool from impact from pucks, sticks or the like.

In accordance with an aspect of the invention, the cable is made of braded nylon wire and guide members are eyelets comprised of metal or plastic to allow for a reduction of friction in movement of the cable when tightening against the eyelets which allows for even distribution of tightening force.

In accordance with an aspect of the invention, the footwear is a skate.

In accordance with an aspect of the invention, the wire is fed through the eyelets the same way as a traditional skate lace, however the cable is not fed through all eyelets so as to distribute tightening force in an efficient manner.

In accordance with an aspect of the invention, the skate has 10 parallel eyelets on opposing sides of the boot and each side of the cable is fed through eyelets 1, 3, 7 and 10 (with 1 being closest to the toe of the boot and 10 being at the upper ankle position as shown in FIG. 4).

In accordance with an aspect of the invention, lacing patterns may vary depending on the size of the skate, for example a size 11 skate has 11 opposing eyelets, therefore you would lace the wire through eyelets 1,3 8 and 11 and for smaller skates with 7 eyelets: You would lace the wire into eyelets 1, 3 and 7 for this orientation.

In accordance with an aspect of the invention, it is desirable not to lace through every eyelet on the skate, so as to find the optimal friction to ensure evenly spread of tightening along the sides of the boot, avoiding the common issue of uneven tightening with traditional lacing systems.

BRIEF DESCRIPTION OF THE DRAWINGS

Reference will now be made, by way of example, to the accompanying drawings which show example embodiments of the present application, and in which.

Similar reference numerals may have been used in different figures to denote similar components.

DESCRIPTION OF EXAMPLE EMBODIMENTS

Figure 1:
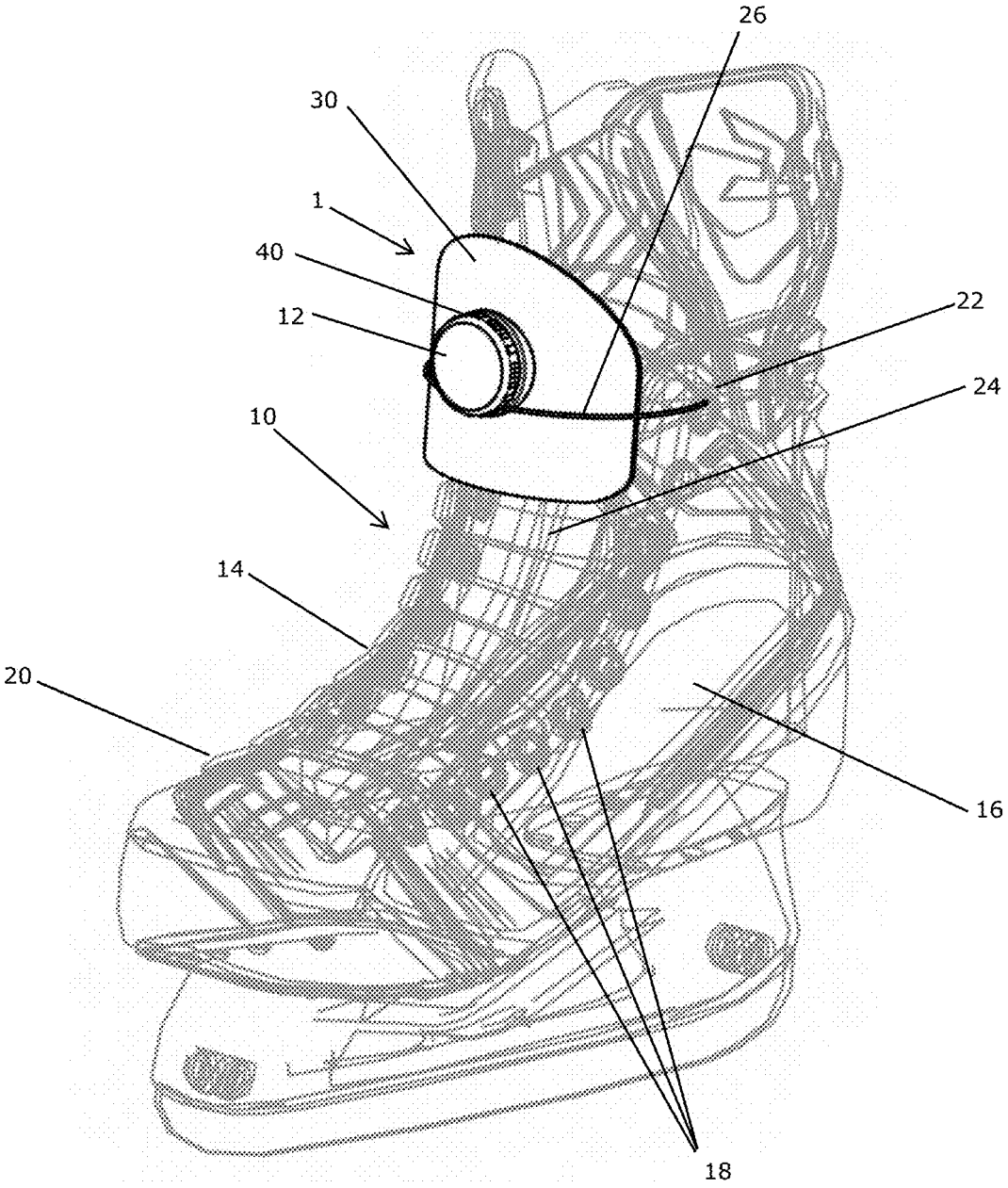
FIG. 1 is a perspective view of a skate with an example embodiment of the lacing system of the invention attached thereto.
Figure 2:
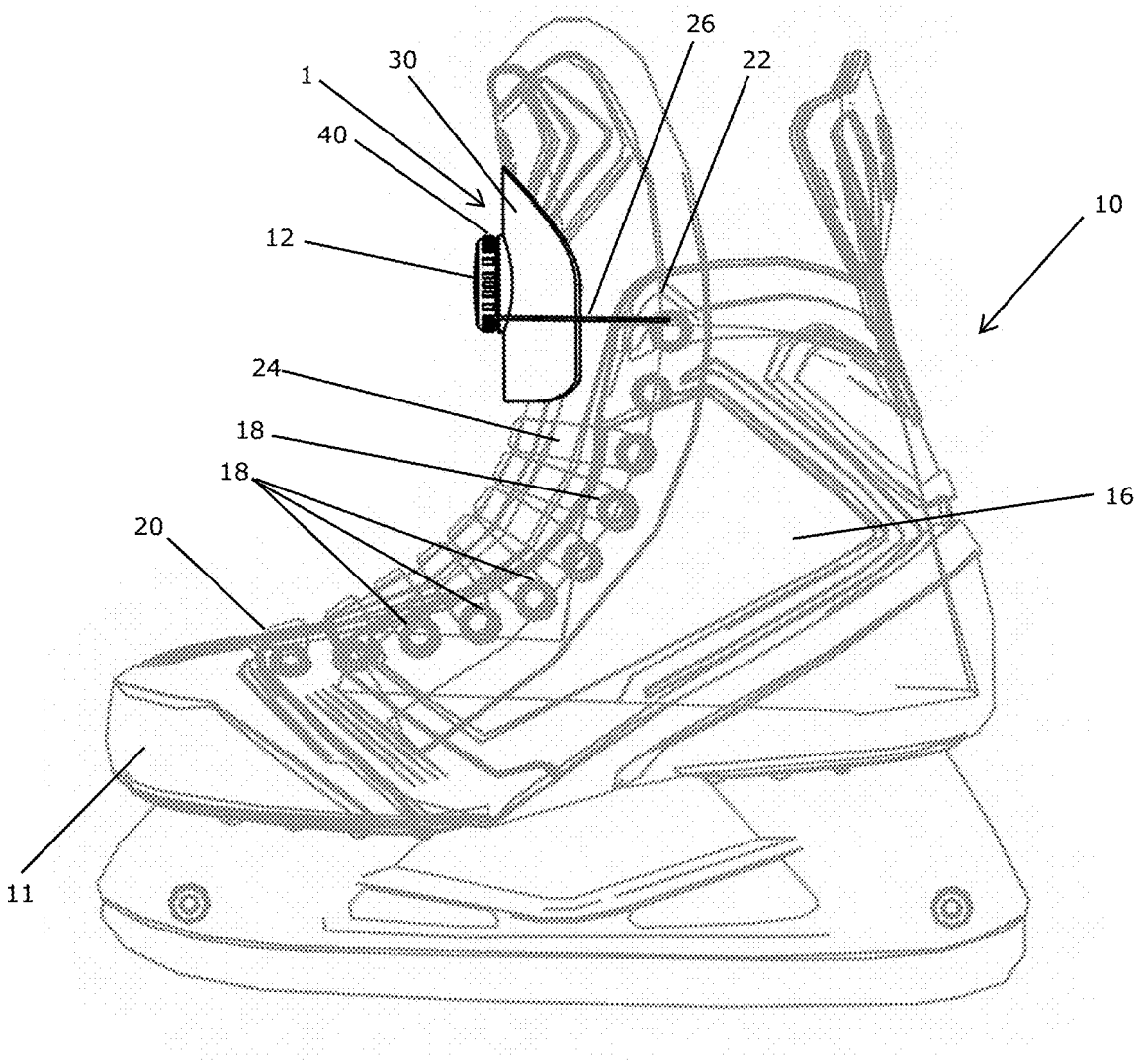
FIG. 2 is a side view of a skate with an example embodiment of the lacing system of the invention attached thereto.
Figure 3:
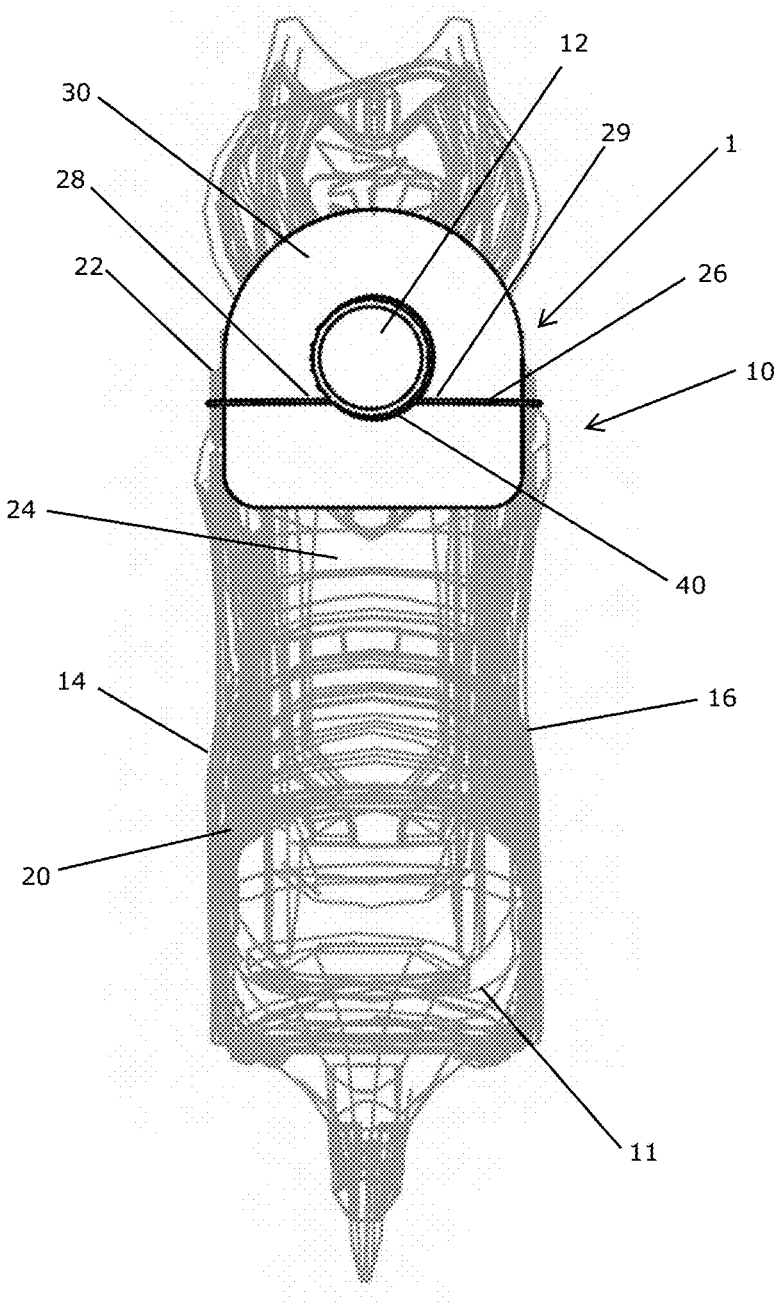
FIG. 3 is front elevation view of a hockey skate with an example embodiment of the lacing system of the invention attached thereto

An example embodiment of the detachable lace tightening system is shown in the drawings. Disclosed in FIGS. 1 to 5 are examples of the detachable skate/boot lace system 1 designed for adaptation to existing boots, such as skates 10. The system involves tightening the lace/wire by the turn of a dial/with spool 12. The footwear such as a skate includes a boot 11 having first 14 and second opposing 16 side configured to fit around a foot, a plurality of opposing cable guide members (eyelets) 18 positioned on the opposing sides from a lower end 20 to an upper end 22, a footwear tongue 24 extending from boot between the opposing sides. The system comprising: a rotatable spool 12 detachably secured to the tongue 24 of the footwear by double sided tape 25. A braded nylon cable 26 is insertable into the eyelet/guide members 18 having a first end 28 and a second end 29. The first and second ends extend outwardly from the eyelets at the upper end 22 of the opposing sides 14,16 and the first and second ends 28, 29 are removably insertable and secured with respect to the rotatable spool with dial 12. A tightening control knob 40 upon said spool winds the cable around the spool 12 to place tension on the cable in a first direction, thereby pulling opposing sides of the footwear towards each other and securing the foot under the tongue 24 and between opposite sides 14,16. A releasable lock is provided for preventing rotation of the spool in the second direction whereby releasing the lock permits the spool to rotate in the second direction to release the tension in the cable and allow removal of the boot.

In the example embodiments of the invention as shown, the dial spool 12 is inserted into a holder (dial housing unit 30). The dial housing unit 30 is then attached to the tongue 24 of any boot with double sided tape. It is contemplated that other means of attachment may be utilized such as by means of the following non exhaustive list: Velcro attaching the dial housing unit to tongue of the boot; attaching the housing unit to tongue by means of elastic band or ribbon; detachable tapes. The ideal tape being utilized does not leave glue residue on the tongue upon removal.

In a preferred embodiment, the attachment cable (also referred to as wire) 26 is fed separately through the indicated eyelets 18 of the skate/boot such that the upper eyelet on opposing sides 14,16 of the boot and adjacent the tongue of the boot has a end of the attachment wire extending therefrom. Each end is fed in to a tightening dial/spool 12 which is mounted to the tongue via the dial housing unit 30. When turning the dial 12, the wire gets wound up inside the spool of the dial, which in turn, tightens the boot. As mentioned above a releasable lock is provided on the spool for preventing rotation of the spool in the second direction whereby releasing the lock permits the spool to rotate in the second direction to release the tension in the cable and allow removal of the boot. While a nylon cable is shown, alternate cables such as metal wires may be used.

Once these steps are complete, a traditional cloth type protective/aesthetic stretch lace, may be fed through all the eyelets (lace it like you would any shoe or boot). The lace is stretchy so that you can easily put your foot in and out of the boot/skate. This protects the wire underneath and is also used for aesthetic/presentation.

Further provided is a cover 32 for the dial and spool 12 (which is attached to the Dial housing unit 30) allows the dial 12 to be protected so damage to the dial can be limited such as by means of a puck or stick during game play. This cover will be made all as one piece with the dial housing unit or a separate attachment. It is designed to slip on and off the dial easily and quickly for release and tightening of the dial. In some embodiments, for example, the cover includes a front panel portion 33 and a pair of end panel portions 34 that extend downwardly and away from the front panel portion. Each end panel portion has an end that is co-operable with at least a portion of the housing unit 30 for releasably coupling the cover portion 32 to the housing unit 30. While the cover portion 32 is arranged relative to the housing unit 30 and the rotatable spool 12 and control knob 40, the front panel portion 33, which extends between respective ones of the pair of end panel portions 34 extends across the rotatable spool 12 and control knob 40 and is effective for shielding the rotatable spool 12 and the control knob 40 from impact while the skate boot is in use. The end panel portions 34 are also effective for shielding the lateral sides of the rotatable spool 12 and the control knob 40 from impact while the skate boot is in use. The arrangement of the cover portion 32 relative to the housing unit 30, rotatable spool 12 and control knob 40 is such that a gap 36 is defined between between an outer front-facing surface of the control knob and an inner surface of the front panel portion 33 and between an inner surface of each of the end panel portions 34 and a side, outer surface of the control knob 40.

Other solutions are the traditional lace tying for any boot/skate which take time to tighten and then tie a bow at the end and can also strain your back when doing so (roughly 30 seconds for boots and 4 minutes for skates). The herein invention will save anyone time and their body will thank them as they are not bent over for too long while tying.

Figure 4:
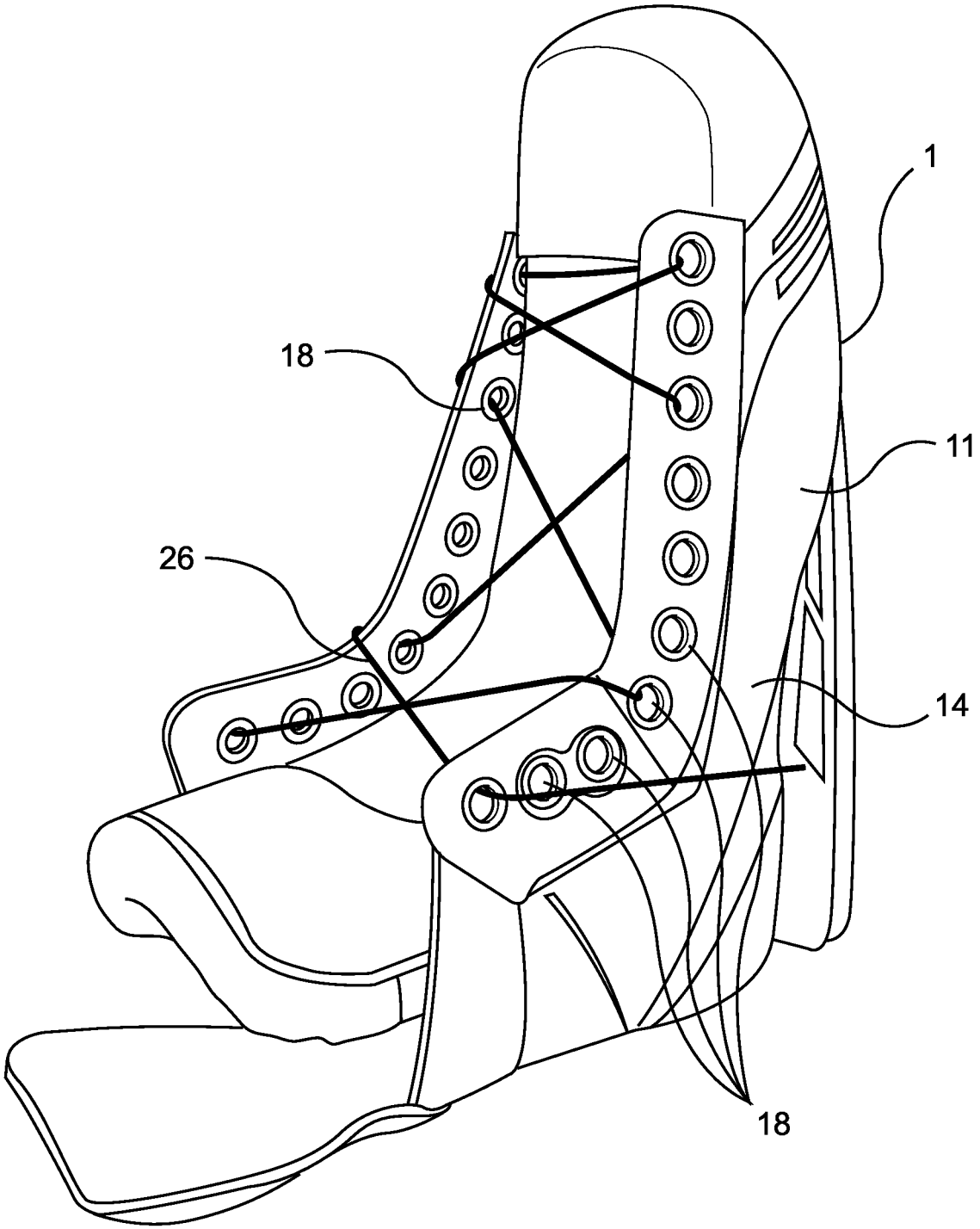
FIG. 4 is an illustration of an example of a skate with preferred lacing orientation of the system.
Figure 5E:
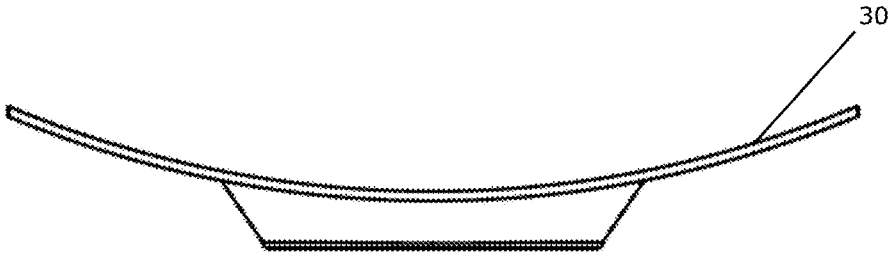
FIG. 5*a-f* are various views of an example dial housing mount in accordance with an aspect of the invention with FIGS. 5C, 5*d* and 5*f* including a protective cover for dial.
Figure 5A:
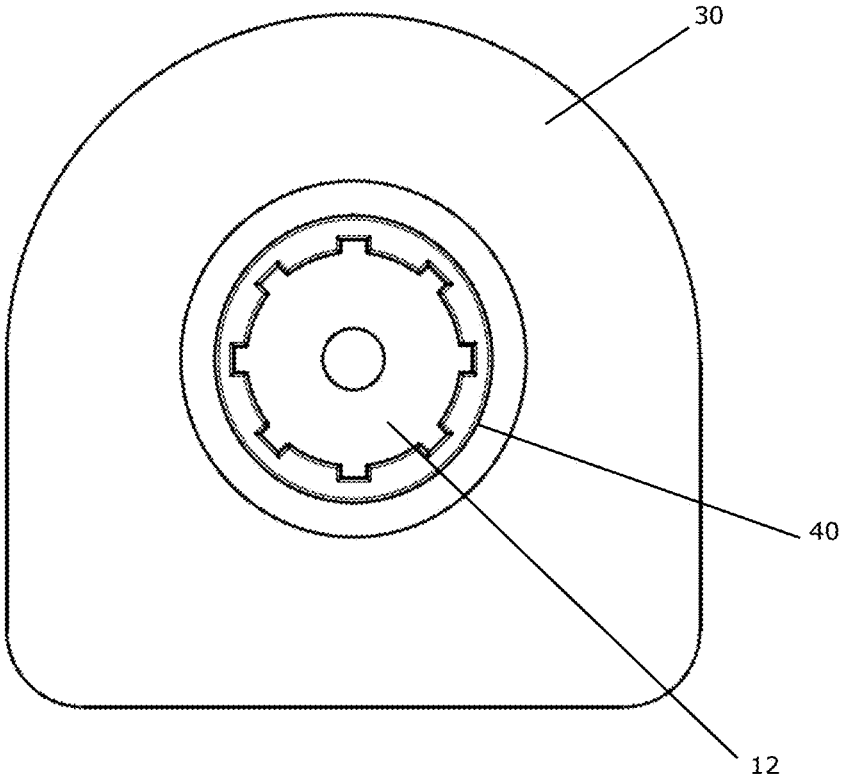
Figure 5B:
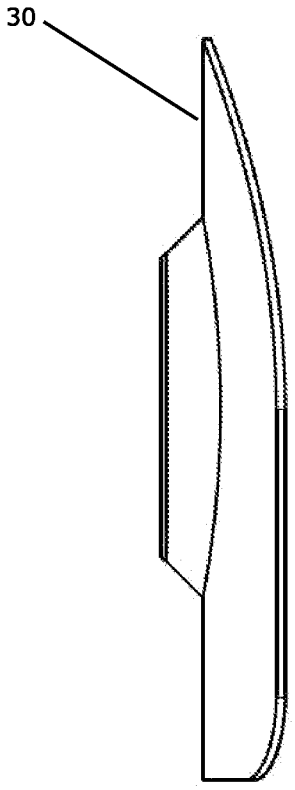
Figure 5D:
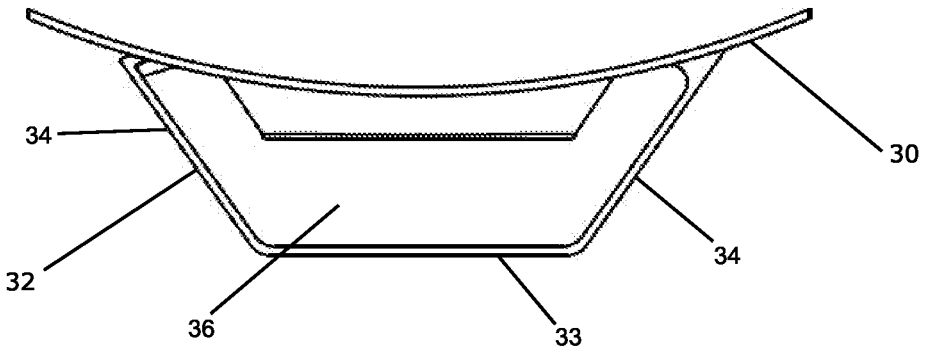
Figure 5C:
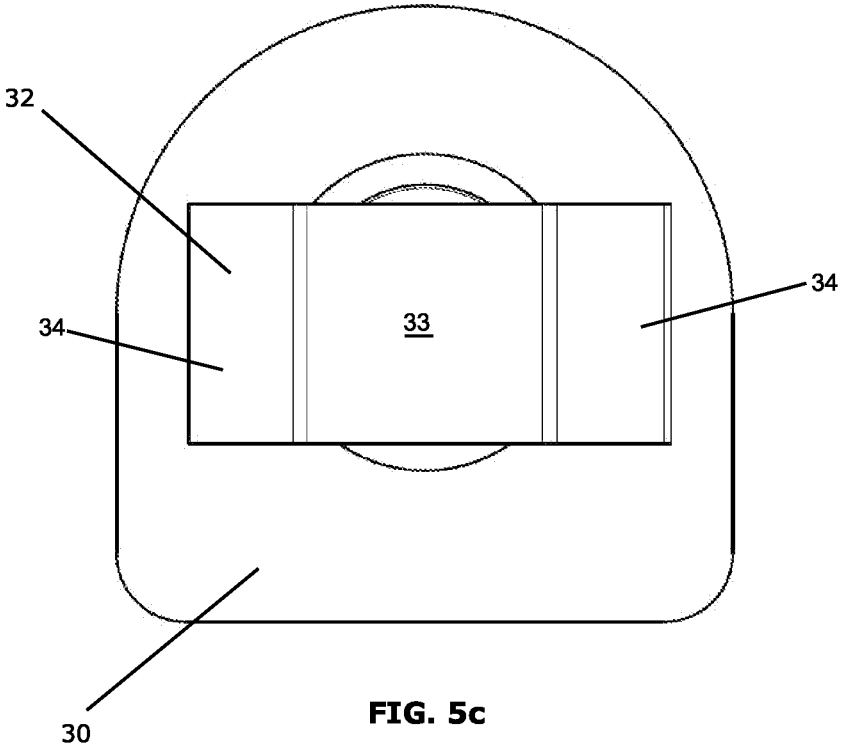
Figure 5F:
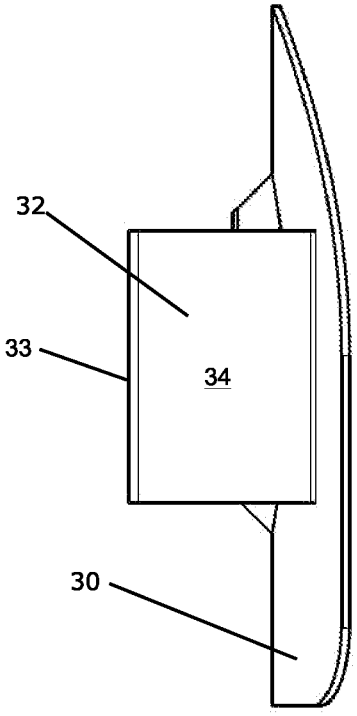

In example embodiments shown, the wire 26 is fed through the eyelets 18 the same way as a traditional skate lace, however because the cable is thin braded nylon wire and eyelets are metal or plastic there is less friction than cloth laces and tightening force is better dispersed. In preferred embodiments, the cable is not fed through all eyelets so as to distribute tightening force in an efficient manner. In FIG. 4 attached, the cable is fed through eyelets 1, 3, 7 and 10 (eyelet 1 is positioned closest to the toe and eyelet 10 is positioned at the top of the boot on each opposite side). This was observed to optimally spread the force in a skate size 7.5 (approx. size 9 shoe) and this lacing variation will be preferred for any skate with 10 eyelets (such as for example skates sizing from shoe size (7-10). Lacing patterns may vary depending on the size of the skate, for example a size 11 skate has 11 eyelets, therefore you would lace the wire through eyelets 1,3 8 and 11. For a kids skate with 7 eyelets: You would lace the wire into eyelets 1, 3 and 7. It is generally not preferred or desirable to lace through every eyelet on the skate, so as to find the optimal friction to ensure evenly spread of tightening along the sides of the boot, avoiding the common issue of uneven tightening with traditional lacing systems.

As shown in FIG. 4, skate size 7.5, you will see the cable wire 26 doesn't cross over to the other side of the boot. It only crosses over at the toe and the ankle area, not the mid foot. This is because, after plenty of testing, this lacing variation was shown to have improved comfort as compared to the traditional way of lacing hurts the foot. With over 14 trials of users for comfortability and performance and without bias, people were plenty happy in how it feels and performs.

To Further Illustrate an Example of the Invention, the Following Sets Out Example Steps of Utilizing the Lace Tightening System with Footwear, in this Example Skates:

Step 1:

Take your existing laces out of skate. Clean off Tongue of the skate with a cloth so tape can adhere better. Peel film off the "Dial mount" (also referred to as Dial housing mount) and adhere it to the tongue of the skate. Once in correct position, press firmly on dial housing mount 30 for 30 seconds in every area to secure adhesive.

Step 2:

Feed "Webbing Lace" (cables 12) into correct eyelets 18 as shown below utilizing the lacing pattern of eyelets 1, 3, 7, 10 or the like such as shown in FIG. 4.

Step 3:

Line up arrow of "spool" with arrow on "Dial". (an example of a dial spool that may be utilized as part of this invention is available through Shenzen Fitgo Technology Co. Ltd. shown in the attached videos available at Shenzhen Fitgo Technology Co., Ltd (http://en.fitgotech.com/) through Shenzen Fitgo Technology Co. Ltd). Any known spool and dial may be utilized in the alternative to this example. Feed one end of webbing lace through the loop of the "loop feeder" and insert point of loop feeder into Dial hole 1. Pull loop feeder out the other end so lace comes through with loop feeder. Tie a regular knot with the webbing lace leaving 7 mm of lace after knot. Take lighter to singe off end of webbing lace so it doesn't fray.

Repeat this step with other end of webbing lace and insert into Dial hole 2.

Step 4:

—Attach Dial 12 to the "Dial Housing Unit" 30—

Line up outside arrow of dial to the arrow shown on Dial housing unit and push dial own into place. Firmly turn dial counterclockwise so it locks into the dial housing unit. See above link to illustrating this procedure.

Step 5:

To tighten Skate, press the dial down and turn clockwise.

To loosen skate pop out dial outwards and release tongue outwards.

Step 6:

Feed the "Protective Stretch Lace" through all of the eyelets, starting from the toe, towards the ankle. (Lace the same way you would a regular hockey lace and make sure there is no left slack). Once Stretch laces are fed through the final eyelets, feed the tip of the laces into the "Lace Buckle"

Step 7:

"Sticker numbers" are provided and of course are optional. Stick your number on the face of the dial Step 8:

You are now ready to hit the ice!

Tighten the system by pressing down on the dial and turning clockwise until preferred tightness. To take skate off, pop out the dial outwards and remove foot from skate. Easy as that.

The above steps are illustrative and certain adaptations and modifications of the described embodiments can be made. Therefore, the above discussed embodiments are considered to be illustrative and not restrictive. Other suitable dials, spools, cables and other components may be used for this invention.

What is claimed is:

1. A detachable lace tightening system for a skate boot, the skate boot having first and second opposing sides, a first set of a plurality of cable guide members positioned on the first side of the boot such that the plurality of cable guide members are disposed in series and in spaced apart relationship along the first side from a lower toe end to an upper ankle end of the skate boot, a second set of a plurality of cable guide members positioned on the second side of the skate boot such that the plurality of guide members are disposed in series and in spaced apart relationship along the second side from a lower toe end to an upper ankle end of the skate boot, and a tongue member extending from the skate boot and arranged such that the tongue member is disposed between the first and second sides of the skate boot, the detachable lace tightening system comprising:

a rotatable spool detachably secured to the tongue member, a cable extending between a first end and a second end, wherein:

the cable is cooperable with the cable guide members for releasably securing the cable to the first and second sides of the skate boot such that a boot and cable co-operating configuration is established; and each of the first end and the second end, independently, is co-operable with the rotatable spool such that, while the boot and cable co-operating configuration is established and the first end and the second end of the cable are releasably coupled to the rotatable spool, the cable and spool are disposed in a lace tightening-ready configuration;

a control knob coupled to the spool such that rotation of the control knob in a first direction effects rotation of the spool in the first direction such that while the cable and spool are disposed in the lace tightening-ready configuration and the control knob is coupled to the spool, rotation of the control knob in the first direction is with effect that the cable is wound around the spool placing the cable in tension such that the first side and the second side of the boot are drawn together over the tongue member with effect that the skate boot is disposed in a lace-tightened condition;

a releasable lock operably coupled to the spool and control knob such that:

while the releasable lock is in a locked condition, rotation of the spool in a second direction, opposite to the first direction, via rotation of the control knob, is prevented; and while the releasable lock is in an unlocked condition, rotation of the spool in the second direction is permitted effecting release of the tension on the cable such that the lace-tightened condition is defeated with effect that removal of the skate boot is permitted;

and a cover portion configured for releasable coupling relative to the rotatable spool and control knob such that, while the cover portion is releasably coupled relative to the rotatable spool and control knob, at least a portion of the cover portion is arranged over top of and in spaced apart disposition relative to the control knob such that the cover portion is effective for shielding the rotatable spool and the control knob from impact while the skate boot is in use.

2. The detachable lace tightening system as recited in claim 1, further comprising:

an adhesive member having a first side configured for adhering to a tongue-facing side of the rotatable spool and a second side configured for adhering to the tongue member such that the adhesive member is co-operable with the rotatable spool for detachably securing the rotatable spool to the tongue member.

3. The detachable lace tightening system as recited in claim 2, wherein the adhesive member is two-sided tape.

4. The detachable lace tightening system as recited in claim 1, further comprising:

a housing unit configured for releasably coupling with the rotatable spool such that, while the rotatable spool is releasably coupled to the housing unit, detachable securing of the rotatable spool to the tongue member is effected via detachable securing of the housing unit to the tongue member.

5. The detachable lace tightening system as recited in claim 4, further comprising:

an adhesive member for detachably securing the housing unit to the tongue member.

6. The detachable lace tightening system as recited in claim 5, wherein the adhesive member is two-sided tape.

7. The detachable lace tightening system as recited in claim 4, wherein the housing unit includes a base plate shaped for a co-operating fit with a front, upper portion of a skate boot.

8. The detachable lace tightening system as recited in claim 7, wherein the cover portion includes:

a front panel portion; and a pair of end panel portions, the front panel portion extending between respective ones of the pair of end panel portions;

wherein each one of the pair of end panel portions, independently, has an end co-operable with the base plate for releasably coupling the cover portion to the baseplate.

9. The detachable lace tightening system as recited in claim 8, wherein each end panel portion of the pair of end panel portions extends downwardly and away from the front panel portion such that one of the end panel portions is releasably coupled to the base plate on a first side of the rotatable spool and control knob, while the other one of the end panel portions is releasable coupled on a second opposite side of the rotatable spool and control knob such that the front panel portion extends across the rotatable spool and control knob.

10. The detachable lace tightening system as recited in claim 9, wherein a cover portion is releasably coupled to the base plate such that a gap is defined between between: (i) an outer front-facing surface of the control knob and an inner surface of the front panel portion, and (ii) between an inner surface of each of the end panel portions and a side surface of the control knob such that an impact force applied to any one of the front panel portion and the end panel portions is isolated away from the control knob and rotatable spool.

11. The detachable lace tightening system as recited in claim 1 wherein:

the cable is a nylon wire;

the first set of the plurality of cable guide members and the second set of the plurality of cable guide members include eyelets, each eyelet, independently, extending through one of the first side and the second side of the skate boot, each eyelet, independently, having an inner surface defined by a friction-reducing surface member;

such that, while the boot and cable co-operating configuration is established and the cable and spool are disposed in the lace tightening-ready configuration, contact between the nylon wire and respective ones of the friction-reducing surface member is effective for reducing friction between the cable and the eyelet and facilitating movement of the cable relative to the eyelet while the control knob is rotated in the first direction, the friction-reducing surface member being selected from one of: a plastic surface member and a metal surface member.

12. The detachable lace tightening system as recited in claim 11 wherein the cable is fed through at least some of the eyelets on the first side of the skate boot and at least some of the eyelets on the second side of the skate boot in a corresponding skate-tightening pattern such that rotation of the control knob in the first direction, while the boot and cable co-operating configuration is established and the cable and spool are disposed in the lace tightening-ready configuration, is with effect that the tension applied to the cable is effective for applying a first side tightening force to the first side of the skate boot in a first direction and a second tightening force to the second side of the skate boot in a second direction, opposite to the first direction, such that the first side and the second side are drawn together.

13. The detachable lace tightening system as recited in claim 12 wherein the skate-tightening pattern is selected such that the first side tightening force is distributed along the first side of the skate boot in a first side distribution pattern and the second side tightening force is distributed along the second side of the skate boot in a second side distribution pattern that is equivalent to the first side distribution pattern.

14. The detachable lace tightening system as recited in claim 12, wherein:

the first set of the plurality of cable guide members includes a total of ten eyelets arranged along the first side of the skate boot such that a first eyelet is arranged at the lower toe end of the first side of the skate boot and a tenth eyelet is arranged at the upper ankle end of the first side of the skate boot;

the second set of the plurality of cable guide members includes a total of ten eyelets arranged along the second side of the skate boot, in parallel relationship to the eyelets arranged along the first side of the skate boot such that a first eyelet is arranged at the lower toe end of the second side of the skate boot and a tenth eyelet is arranged at the upper ankle end of second side the skate boot; and the skate tightening patter is such that the cable is fed through each of the first, third, seventh and tenth eyelet on each of the first side and the second side of the skate boot, while the second, fourth, fifth, sixth, eighth and ninth eyelets on each of the first side and the second side of the skate are free from the cable.

* * * * *